United States Patent [19]

Kovach et al.

[11] Patent Number: 4,997,452

[45] Date of Patent: Mar. 5, 1991

[54] SUBLIMATION TRANSFER PRINTING PROCESS FOR ELASTOMER-COATED VELCRO TM FABRICS

[76] Inventors: Cynthia L. Kovach; Larry J. Kovach, both of Rte. 2, Box 394, Trinity, Ala. 35673

[21] Appl. No.: 438,685

[22] Filed: Nov. 17, 1989

[51] Int. Cl.[5] ..... D06P 5/00

[52] U.S. Cl. ..... 8/471; 8/467; 8/468; 8/919; 8/924

[58] Field of Search ..... 8/471

[56] References Cited

FOREIGN PATENT DOCUMENTS 3005176 9/1980 Fed. Rep. of Germany .
52-152583 12/1977 Japan .
1343978 1/1974 United Kingdom .

*Primary Examiner*—A. Lionel Clingman

*Attorney, Agent, or Firm*—Phillips & Beumer

[57] ABSTRACT

An improved sublimation transfer process for printing color images on elastomer-coated fabric such as woven nylon is disclosed. The improved process includes a preliminary step in which a transfer sheet having sublimable dyes placed thereon is subjected to a pretreatment to condition it so as to avoid ghost images or haziness that would otherwise result when applying such process to elastomeric coated material. The pretreatment is carried out by placing the dye-containing transfer sheet in contact with a sheet of absorbent paper and heating this assembly under specified conditions to cause excess dyes to be conveyed into the absorbent sheet. The resulting dye-containing absorbent sheet is then removed, and printing may be carried out using known process conditions. The improved process is particularly useful for printing multicolor images on the back side of Velcro hook and loop tapes.

4 Claims, No Drawings

SUBLIMATION TRANSFER PRINTING PROCESS FOR ELASTOMER-COATED VELCRO TM FABRICS

FIELD OF THE INVENTION

This invention relates generally to sublimation transfer printing processes and more particularly to an improved sublimation transfer process for imprinting multicolor designs onto elastomer-coated fabrics.

BACKGROUND OF THE INVENTION

Velcro hook and loop fasteners are widely used for attaching one object to another. These devices are made up of two mating tapes, a hook tape that has a large number of minute flexible hooks woven into a nylon fabric substrate and a loop tape having loops woven into a second nylon substrate. When the two tapes are pressed together, the hooks engage the loops, forming an adjustable, highly secure, and jam-proof closure. To reopen, the tapes are simply pulled apart.

Many applications would exist for such hook and loop tapes for the purpose of displaying designs or other graphic material on the back, smooth side of the tape. For example, one tape could be secured to a chart board with its hook or loop side out, and a mating piece of the other tape with graphics on its back side could be removably attached to the first side so as to enable the graphics to be moved to different locations along the chart. Company logos, advertising material, and the like could also be displayed on the tape. Such applications would be facilitated by the availability of an effective process for printing of graphics onto the back side of the hook or loop tape.

Substantial difficulty has been encountered in printing of multicolor graphic materials onto the backs of hook and loop tapes owing to the surface structure of the tape. The back or smooth side of the tapes has an elastomeric binder coat applied over a woven nylon substrate having hooks or loops woven into the substrate. The binder coat locks the hooks or loops into the ground weave and helps to prevent the tape from unravelling when cut. This coating interferes with the use of screen printing processes in that the tape material will not accept many of the dyes used for screen printing, causing the design material to run together or peel. In particular, application of more than two colors by screen printing has presented such problems. Sublimation heat-transfer printing processes have also been attempted for applying multicolor materials to hook or loop tapes, but with little success. Prints applied by sublimation heat transfer processes have been characterized by defects such as the appearance of ghost images and a haziness or lack of sharpness. Difficulties in printing of multicolor designs on Velcro material may also be attributed to movement of the fabric when opening or closing a heat transfer press because of the presence of hooks or loops in the material. In carrying out these processes, much material may be wasted owing to the poor quality, unusable, or marginal results obtained. Costs are increased due to the large amount of scrap generated and the amount of time consumed.

SUMMARY OF THE INVENTION

The present invention is directed to an improved sublimation heat-transfer printing process suitable for applying multicolor graphic material to elastomer-coated woven fabric and in particular to the smooth side of Velcro hook and loop tapes. The improved process modifies existing sublimation heat-transfer processes by including an additional, preliminary step of conditioning of a transfer paper containing sublimable dyes by bringing the paper into contact with a sheet of absorbent material such as absorbent paper and heating the sheets under pressure for a predetermined period of time, which may vary rom two or three seconds to a minute. The absorbent sheet is then discarded, and the conditioned transfer sheet is used for printing onto the elastomer-coated fabric by means of conventional process steps. The improved process eliminates double imaging and hazy prints, providing reproducible and highly effective results. Although the invention is not to be understood as limited to a particular theory, these favorable results are believed to be produced by removal of excess amounts of dyes, which contribute to hazy and double imaging.

It is, therefore, an object of this invention to provide an improved process for sublimation heat-transfer printing of multicolor material onto elastomer-coated woven fabric.

Another object is to provide such a process that is simple to use, time-saving, and inexpensive.

Another object is to provide a method of conditioning a sublimable dye transfer sheet to enable its use for printing on the smooth side of Velcro hook and look tapes.

Other objects and advantages of the invention will be apparent from the following detailed description and appended claims.

DESCRIPTION OF THE PREFERRED EMBODIMENT

The improvement of the present invention is applicable to a process wherein a transfer sheet having sublimable dyes on its surface is superimposed over a substrate to be printed upon, and the transfer sheet is selectively heated to transfer the dye, thus forming an image on the substrate.

A dye transfer sheet having an image superimposed on its surface may be prepared by first using an automatic color scanner which produces a screened film negative of the image with a dot pattern that duplicates the tonal values of a continuous tone photograph or graphic artwork. The color scanner scans for each of the four colors used in full color printing by means of a filter which screens out three of the colors on each pass. For best results in use of a color areas by means of a densitometer and adjusts dials on the scanner as required. The scanner is then actuated, producing a positive or negative film for each of the primary colors and black.

A thin sheet or plate of metal is coated with an oil-based emulsion, and the coated sheet or plate is placed in contact with the screened film negative, on which an image has been developed. The portions of the image which are to be printed are so dense that light cannot pass through them. Portions which are not to be printed are left clear on the negative. A bright light is turned on briefly so as to strike the emulsion coating on the plate at locations where the negative has been left clear. The light causes a chemical reaction in the emulsion. Where the image exits on the negative, no light can pass through, and the emulsion remains undisturbed. The plate is then removed from contact with the negative and is washed in a chemical solution, which attacks the portion of the plate where light was permitted to pass. Washing of the plate removes the emulsion from areas where light did not strike the emulsion, leaving those areas bare. At areas where light did strike the emulsion, it remains intact and is allowed to harden.

The emulsion-containing plate is then mounted on a cylinder of a printing press, and the cylinder is rotated to lightly wet the plate with water. Bare metal areas are readily wetted by the water, while emulsion-containing areas repel water. Sublimable dyes or inks are applied by rotating the cylinder so that the wetted plate comes into contact with sublimable, oil-based inks or dyes, which adhere to emulsion coated areas. Since water and oil repel each other, no ink or dye is deposited on the wetted, blank areas. The image is then applied to a transfer paper sheet by brining the plate cylinder into contact with a paper sheet mounted on a rubber blanket cylinder. Each of the three primary colors and black as a fourth color may be applied to the transfer paper by this means.

The improvement of the present invention may be carried out by preheating a heat transfer press to an elevated temperature such as 350° F. to 400° F., placing the sublimation heat transfer sheet in contact with an absorbent sacrificial material such as absorbent paper, in particular a paper towel, or cloth and closing the heat transfer press to apply pressure to the assembly for a predetermined period of 2 to 60 seconds, depending upon the specific transfer sheet being used. The amount of pressure is not critical so long as the sheets are maintained in firm contact. The absorbent sheet is then removed and discarded, and printing may then be carried out using previously known methods. The step of first contacting transfer sheets with absorbent material as described serves to condition the sheets and remove excess dye that would otherwise cause difficulty when the process is applied to elastomer-coated fabrics such as the back side of Velcro tapes.

Contact time required for conditioning of a specific transfer sheet may be determined by conducting a few tests for each new batch of transfer sheets to establish the optimum amount of time required to remove excess dyes for that batch. In general, a period of 2 to 60 seconds is required. Once this time is established for one sheet in a given batch, it may be used for all other sheets in that batch.

For printing of artwork onto the back side of Velcro tape material, a transfer sheet conditioned as described above may be used in methods in which the transfer sheet is contacted with the tape under pressure and at a temperature such as 350° to 400° F., with best results being obtained at a temperature of 375° F. for a contact time of 30 to 40 seconds. Temperatures over 400° F. may cause scorching. Sharp images with accurate color rendition may be obtained reproducibly by this means. The applied dyes become interlocked with the weave of the Velcro material, providing a colorfast image.

The invention enables successful printing in full color on a smooth side of Velcro hook or loop fastening tape and opens the way for use of such tapes for decorations or displays, apart from their use as fasteners. Removable, reusable patches for application to clothing may be made up to display artwork such as sports logos and insignia or the like. For such applications, the article of clothing or portions thereof would be made of Velcro hook or loop material or other fabric designed for engagement therewith such as Velvet Loop fabric manufactured by Design Craft Fabric Corporation. Charts or wallcoverings may also be made up to include such engagable fabrics at selected locations so as to allow colorful graphics displays to be removably attached. Educational displays or game boards, toys, and the like may also make advantageous use of Velcro tapes having images printed thereon. Other applications include promotional material and signs in stores for displaying prices and the like.

Although the invention is described above with reference to a specific embodiment, it is not to be understood as limited thereto, but is limited only as indicated by the appended claims.

We claim:

1. In a process which comprises providing a transfer sheet having on a surface thereof sublimable dyes forming a color image and contacting such sheet with a substrate comprising woven nylon having interwoven hook or loop material on one side and being coated on its other side with an elastomeric material at an elevated temperature such as to cause said dye to be sublimed and printed on said substrate, the improvement comprising:

prior to contacting said sheet and said substrate, placing said transfer sheet in face-to-face contact with a sheet of absorbent paper;

heating the resulting assembly under pressure at 350° F.–400° F. for 2 to 60 seconds sufficient to remove excess dyes from said transfer sheet, whereby said excess dyes are absorbed by said sheet of absorbent material; and separating the resulting dye-containing absorbent sheet from the transfer sheet, whereby the transfer sheet is conditioned for being effectively contacted with the substrate for imprinting said image thereon.

2. The improvement as defined in claim 1 wherein the image transfer sheet includes three primary colors.

3. The improvement as defined in claim 2 wherein the heat transfer sheet includes black color.

4. The improvement as defined in claim 1 wherein said absorbent paper is a paper towel.

* * * * *